US005762379A

United States Patent [19]

Salmon et al.

[11] Patent Number: 5,762,379

[45] Date of Patent: Jun. 9, 1998

[54] PRINTED ARTICLE

[75] Inventors: Joseph P. Salmon; Eugene M. Dukatz, both of West Bend, Wis.

[73] Assignee: Serigraph, Inc., West Bend, Wis.

[21] Appl. No.: 601,084

[22] Filed: Feb. 14, 1996

[51] Int. Cl.[6] ..... B42D 15/00

[52] U.S. Cl. ..... 283/91; 283/109

[58] Field of Search ..... 428/40.1, 40.9, 428/41.7, 42.1, 201, 203, 204, 205, 913.3, 172, 207, 213; 156/220; 427/258, 288, 172, 270; 283/107, 109, 111

[56] References Cited

U.S. PATENT DOCUMENTS

| | | | |
|---|---|---|---|
| 2,276,567 | 3/1942 | Donaldson | 428/203 |
| 3,912,842 | 10/1975 | Swartz | 428/172 |
| 4,933,218 | 6/1990 | Longobardi | 428/38 |
| 5,082,703 | 1/1992 | Longobardi | 428/38 |
| 5,106,126 | 4/1992 | Longobardi et al. | 283/94 |
| 5,270,101 | 12/1993 | Heichler | 428/205 |
| 5,635,283 | 6/1997 | Lovison | 428/204 |

FOREIGN PATENT DOCUMENTS

| | | | |
|---|---|---|---|
| 0159828 | 10/1985 | European Pat. Off. | 283/107 |
| 56-115211 | 9/1981 | Japan . | |

*Primary Examiner*—Willmon Fridie, Jr.
*Attorney, Agent, or Firm*—Bronson, Bronson & McKinnon

[57] ABSTRACT

An article, and method for making the same, including a film of reflective material, a textured pattern associated with the one surface of the film such that the film substantially conforms to the textured pattern, and an ink design forming an image associated with the other surface of the film.

32 Claims, 2 Drawing Sheets

PRINTED ARTICLE

BACKGROUND OF THE INVENTION

1. Field of Invention

The present invention relates generally to printed articles and, more particularly, to printed articles such as trading cards, greeting cards, signs, posters, labels, decals, book covers, decorative panels, name plates and the like.

2. Description of the Related Art

A variety of printing techniques have been developed over the years to produce aesthetically pleasing effects, such as the appearance of depth and three-dimensionality. One way to provide a three-dimensional appearance is to simulate embossing and etching. One technique is disclosed in Japanese Laid Open Patent Application No. 56-115211. Specifically, a pre-printed sheet is deformed to produce an "irregular" appearance. U.S. Pat. No. 4,933,218 discloses a method of printing on the second surface of a transparent substrate that will purportedly simulate etching and embossing. The "first surface" of a transparent substrate is the surface which faces the viewer and the "second surface" is the side opposite that which faces the viewer. The disclosed method involves the deposition of an extraordinarily thick layer of ink at the edge of a printed image formed on the second surface of the transparent substrate. According to the patent, the extraordinarily thick layer gives the illusion of depth when the printed product is viewed from the first surface. A reflective sheet may be applied over both the printed image and thick layer. U.S. Pat. No. 5,082,703 states that this sheet may be replaced by a reflective coating.

Techniques have also been developed for producing printed images having both flat and metallic portions. One such technique in disclosed in U.S. Pat. No. 3,912,842. This patent discloses a printing technique wherein white ink is applied to selected portions of an aluminum foil sheet. An image consisting of at least partially translucent ink is then printed on the sheet, including those portions covered by the white ink. Another technique for producing flat and metallic images is disclosed in U.S. Pat. No. 5,106,126. In the disclosed method, a translucent image is printed on the second surface of a transparent substrate, opaque ink is applied over selected portions of the image and a reflective coating is applied over both the image and the opaque ink.

SUMMARY OF THE INVENTION

A general object of the present invention is to provide a printed article, and method for producing the same, that is superior to those previously known in the art. In particular, one object of the present invention is to provide an article having images printed on two sides that is less expensive than that provided by prior methods. Another object is to provide front to back registration that is superior to that found in two-sided articles produced by know methods.

In accordance with one aspect of the present invention, these and other objectives are accomplished by providing a printed article including a film, a textured pattern associated with one surface of the film in such a manner that the film substantially conforms to the textured pattern and an effect corresponding to the textured pattern is formed on the other surface of the film, and an ink design forming an image associated with the other surface. The textured pattern is preferably formed on a base. Additionally, an image and/or textured pattern may be printed on the opposite side of the base to produce a two-sided article.

Articles produced in accordance with this aspect of the present invention are far superior to those produced by presently known production methods. For example, a two-sided article, such as a trading card, poster, decal or sign, may be produced by printing an image (such as player statistics in a sports trading card) on the side of the base opposite that which supports the textured pattern. This eliminates the need to laminate two separately printed articles to one another, the method presently used to produce two-sided cards. Known lamination methods present certain problems. Not only does lamination add to the cost of producing two-sided objects, but misregistration (misalignment of the images on opposite sides of the sign, poster or card relative to one another) is often introduced during the lamination process. Through the structure and method of the present invention, this registration problem is greatly reduced if not eliminated.

In accordance with another aspect of the present invention, the film which conforms to the textured pattern may be a reflective film. An image may be formed on the side of the reflective film opposite that which is associated with the textured pattern. When the image is produced with translucent inks, the image will have a shiny, metallic appearance in addition to the effect produced by the textured pattern. Moreover, a selectively applied layer of less translucent ink may be applied between the reflective film and the translucent ink. As the less translucent ink diminishes the light being reflected by the reflective film, portions of the image having the less translucent ink thereupon (such as a person's face) will appear flat, while other portions of the image (such as a helmet worn by the person) will appear shiny. All of these advantages may be accomplished in the context of the aforedescribed structure yielding the attendant advantages over the prior art.

Many other features and attendant advantages of the present invention will become apparent as the invention becomes better understood by reference to the following detailed description considered in conjunction with the accompanying drawings.

BRIEF DESCRIPTION OF THE DRAWINGS

Detailed description of the preferred embodiment of the invention will be made with reference to the accompanying drawings.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention. The scope of the invention is defined solely by the appended claims.

Figure 1:
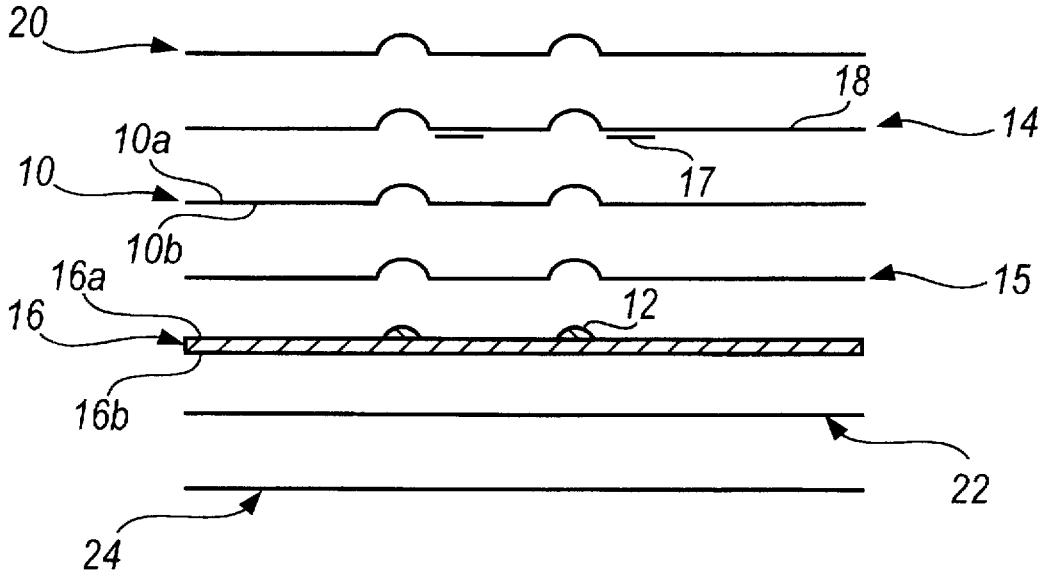
FIG. 1 is an exploded cross-section view of a printed article produced in accordance with the present invention.

As illustrated in FIG. 1, the preferred embodiment of the present invention includes a film 10 having a surface **10*a* and a surface 10*b*, a textured pattern 12 associated with surface 10*b*, and an ink design 14 associated with surface 10*a*. Film 10 conforms to the textured pattern 12 in such a manner that surface 10*a* is textured in a manner corresponding to pattern 12, thereby giving surface 10*a*** a textured or raised, or embossed effect. As discussed in greater detail below, the textured pattern and ink design may be cooperatively configured such that the embossed effect is applied to portions of the ink design which would benefit from a textured appearance. If, for example, the ink design includes an image of a basketball player, such portions of the design may include the folds in the player's uniform, the basketball, or even the entire player whenever it is desirable to set the player apart from the background.

In accordance with the preferred embodiment, textured pattern 12 may be formed from a standard ink deposited onto a base 16 by processes such as silk screening, lithography, flexography and coating. The ink is preferably an ink which cures in response to the application of ultraviolet light (hereafter "UV ink"). Although the thickness of the textured pattern should be approximately 0.1 mil to insure visibility, the thickness may be made larger or smaller to suit particular applications. As is known in the art, if a thickness greater than that which can be produced with a single silk screened layer is desired, then multiple layers may be used.

Although film 10 may be formed from any suitable material, it must be sufficiently pliant to conform to the textured pattern. The opacity of the film may range from opaque to transparent. If a reflective film is desired, exemplary materials include various types of metal foil and metalized polyester. The film, whether or not reflective, can be secured to textured pattern 12 and base 16 in the manner described below. Alternatively, a reflective film may be formed by depositing a layer of reflective silver ink, or any other reflective solution, over the textured pattern and base through a screen printing process. A reflective film may also be formed by electroplating or vacuum metallizing a dry reflective powder onto the textured pattern and base.

When a metal foil is used, specific laminating techniques include roll leafing and hot stamping. In that case metal foil is secured to a carrier, such as polyester film, with a release layer therebetween. An adhesive, either heat activated or pressure sensitive, is applied to the exposed side of the metal. Pressure (as well as heat, if the adhesive is heat activated) is applied to bond the metal to textured pattern 12 and base 16. The carrier is then removed. In some instances some of the release coat will remain on the exposed surface of the metal foil. As such, a primer should be applied to the metal foil to insure that the ink which forms design 14 will stick to it. The primer may be water based, UV curable or conventional and may be applied by lithography, silk screening or flexography.

Similarly, when metalized polyester is used as the reflective film, a heat activated or pressure sensitive adhesive is applied to the metal surface. Pressure (as well as heat if the adhesive is heat activated) is used to apply the metal surface to the pattern and base. The exposed polyester side of the metalized sheet may be print treated in a solvent bath or top coated with a primer that will help the ink which forms image 14 adhere to the polyester.

Base 16 is preferably formed from board or paper stock that is between 8.0 and 30.0 mils thick, although thicker or thinner stock may be used where the application requires. In applications such a trading cards, stock that is approximately 10.0 mils thick is typically used. The board or paper stock should be treated with a moisture stable coating that will prevent ink from being absorbed by the stock. For applications where greater flexibility is required, such as decals, the base may be relatively thin or composed of a flexible plastic material. Conversely, thicker stock and rigid plastic may be used in applications where rigidity is required, such as free standing displays.

Some adhesives tend to adhere better to one substance than another and, depending on the materials used, it can be difficult to find an adhesive that will properly adhere to both textured pattern 12 and base 16. Should this problem arise, the textured pattern and base may be treated with a primer (shown by reference numeral 15) that will give both a plastic surface. An adhesive that is adapted to adhere to plastic may then be used to secure film 10 to the pattern and base.

In the exemplary embodiment, film 10 is reflective and at least a portion of ink design 14 is composed of translucent inks. However, the entire image may be formed from translucent ink if desired. As light passes through the translucent ink, it will be reflected back by the reflective film. This reflection will give the ultimate product a shiny, metallic appearance. Exemplary ink design 14 is composed of two layers—a selectively applied layer of ink 17 and a layer of ink 18 which forms an image. Ink layers 17 and 18 may be applied by suitable printing methods including, but not limited to, silk screening, lithography and flexography. It should be noted the layers 17 and 18 may actually consist of more than one layer of ink, depending on the printing processes employed and the image to be produced.

Turning first to layer 17, ink which is less translucent than that used in layer 18 is deposited over the selected portions of the reflective film prior to the deposition of layer 18. The opacity of layer 17 may range from slightly less translucent than layer 18 to completely opaque. Layer 18 is then deposited over the layer 17 and the portions of the reflective film which were not covered by layer 17. Layer 18 is composed, at least in part, of translucent ink. Portions of ink layer 18 which are formed with translucent ink and do not overly the layer 17 will appear shiny and metallic as light is reflected by the reflective film. Conversely, those portions of ink layer 18 which overly layer 17 will have a flat appearance because the less translucent ink will prevent light from being reflected by the reflective film.

Figure 2:
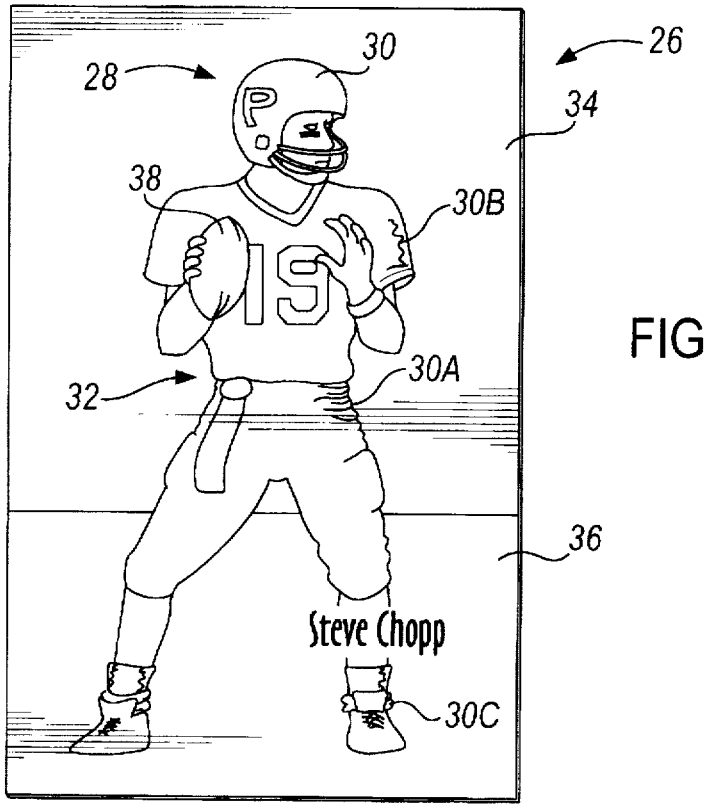
FIG. 2 is a plan view of one side of a sports trading card produced in accordance with the present invention.

One side of an exemplary sports trading card 26 produced in accordance with the present invention is shown in FIG. 2. Referring to the numbered elements in FIG. 2, the printed image includes a football player 28 wearing a helmet 30 and a uniform 32, a sky 34 and grass 36. The player is holding a football 38. The exemplary image is printed in translucent ink. To produce the selective metallic and flat portions described above, trading card 26 includes a reflective film and a layer of less translucent ink thereover. The less translucent ink covers the entire reflective film except for those areas corresponding to helmet 30 and football 38. Thus, the helmet and football will appear shiny, while the rest of the image will have a flat appearance. Turning to texture, a textured pattern is applied in such a manner the portions 30*a–c* of uniform 30 and the laces and seams of football 38 are effected. Thus, a textured, embossed effect is produced with respect to these aspects of the image.

As shown by way of example in FIG. 1, a protective layer 20 may be deposited over ink design 14. Any suitable transparent material may be used. Exemplary materials include transparent ink (either water based, UV curable or conventional solvent evaporative), catalyst and resin systems which produce a hard finish, and polyester sheets. Transparent ink and catalyst and resin systems may be applied with a coater, while the polyester sheet may be secured with a clear adhesive. The thickness of protective layer 20 may be varied in order to achieve the desired surface texture and appearance. If a relatively thin (approximately 1.0 to 2.0 mils) protective layer is employed, the top surface of the finished product will have a texture that corresponds to that of textured pattern 12. Thicker (approximately 10.0 mils) protective layers give the finished product the appearance of depth.

The thickness of a protective layer applied with coaters may be varied by varying the number of coating layers applied. The thickness of a polyester sheet protective layer will vary with the thickness of the protective sheet and the clear adhesive (either heat activated or pressure sensitive) which secures the sheet to ink design 14. For example, the adhesive layer may be as thin as 1.2 mils and the polyester sheet may be as thin as 0.25 mils, for a combined thickness of approximately 1.5 mils. Thicknesses of approximate 10.0 mils may be achieved with a 2.0 mil sheet and 8.0 mils of adhesive, with a 7.0 mil sheet and 3.0 mils of adhesive, and with all combinations therebetween.

Figure 3:
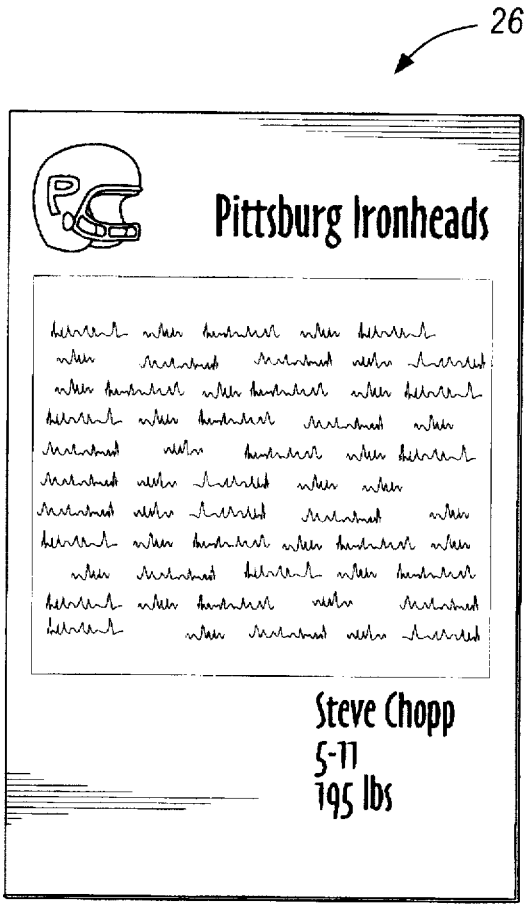
FIG. 3 is a plan view of the other side of the sports trading card shown in FIG. 2.

Referring again to FIG. 1, base 16 includes a surface 16*a*, which is associated with textured pattern 12, and a surface 16*b*. As shown in FIG. 1, an image 22 may be applied to surface 16*b* to produce a two sided-product. One example of such an image is shown in FIG. 3, which illustrates the other side of sports trading card 26. Image 22 may be applied through silk screening, lithography, flexography and other techniques known to those of skill in the art. A protective layer 24 constructed in the manner described above with respect to protective layer 20 may also be applied over this image or simply over surface 16*b* if no image is present. The production of two-sided articles in this manner eliminates the need to laminate two separately printed articles to one another, as was done in prior methods. As a result, two-sided articles produced in accordance with the present invention are less expensive to manufacture and will not suffer from the misregistration that is often introduced during the lamination process.

Where a one-sided product such as decal or nameplate is desired, a layer of adhesive, such as a pressure sensitive adhesive, may be applied to surface 16*b* (or over protective layer 24 if present). However, a two-sided decal such as those commonly applied to windows may be manufactured by adding a layer of adhesive over image 22 or, if present, protective layer 24.

Although the present invention has been described in terms of the preferred embodiment above, numerous modifications and/or additions to the above-described preferred embodiments would be readily apparent to one skilled in the art. It is intended that the scope of the present invention extends to all such modifications and/or additions and that the scope of the present invention is limited solely by the claims set forth below.

What is claimed is:

1. A device, comprising:

a sheet of board stock having at least one surface;

a deposit of ultraviolet light curable ink on the at least one surface of the board stock, the deposit of ultraviolet light curable ink defining a textured design;

a film of reflective material covering the at least one surface of the board stock and the textured design and substantially conforming to the at least one surface of the board stock and the textured design, the film of reflective material defining a surface adjacent the board stock and textured design and a textured surface opposite the surface adjacent the board stock;

a deposit of substantially opaque ink associated with the textured surface of the film of reflective material in a predetermined pattern whereby first portions of the textured surface of the film of reflective material are covered by the substantially opaque ink and second portions of the textured surface of the film of reflective material are left uncovered;

a deposit of substantially translucent ink over the deposit of substantially opaque ink and the uncovered portions of the textured surface of the film of reflective material; and a deposit of substantially transparent material over the deposit of substantially translucent ink.

2. A device as claimed in claim 1, wherein the film of reflective material comprises at least one of hot stamping foil and roll leaf foil.

3. A device as claimed in claim 1, wherein the film of reflective material comprises metalized polyester.

4. A device as claimed in claim 1, wherein the substantially transparent material comprises ink.

5. A device as claimed in claim 1, wherein the substantially transparent material comprises plastic.

6. A device, comprising:

a base;

a textured pattern including raised portions formed on the base;

a film of reflective material associated with the textured pattern and substantially conforming to the textured pattern, the film defining a surface facing the textured pattern and a textured surface opposite the surface facing the textured pattern; and an ink design forming an image associated with the textured surface of the film.

7. A device as claimed in claim 6, wherein the textured pattern comprises a deposit of ultraviolet light curable ink.

8. A device as claimed in claim 6, wherein the ink design comprises a first ink and a second ink, the first ink being substantially translucent and the second ink being substantially less translucent than the first ink.

9. A device as claimed in claim 6, wherein the ink design comprises a first deposit of ink substantially adjacent to the textured surface of the film of reflective material, the first deposit of ink defining a predetermined pattern whereby first portions of the textured surface of the film of reflective material are covered by the first deposit of ink and second portions of the textured surface of the film of reflective material are left uncovered.

10. A device as claimed in claim 9, wherein the ink design further comprises a second deposit of ink over the first deposit of ink and uncovered portions of the textured surface of the film of reflective material, the first deposit of ink being substantially less translucent than the second deposit of ink.

11. A device as claimed in claim 10, wherein the first deposit of ink comprises a substantially opaque ink and the second deposit of ink comprises a substantially translucent ink.

12. A device as claimed in claim 6, wherein the reflective material comprises at least one of hot stamping foil and roll leaf foil.

13. A device as claimed in claim 6, wherein the reflective material comprises metalized polyester.

14. A device as claimed in claim 6, wherein the reflective material is substantially opaque.

15. A device as claimed in claim 6, further comprising:

a deposit of substantially transparent material over the ink design.

16. A device as claimed in claim 15, wherein the transparent material comprises ink.

17. A device as claimed in claim 15, wherein the transparent material comprises a sheet of plastic.

18. A device as claimed in claim 6, in which the base defines a surface associated with the surface of the film of reflective material facing the textured pattern.

19. A device as claimed in claim 18, wherein the base comprises board stock.

20. A device as claimed in claim 18, wherein the textured pattern comprises an ultraviolet light curable ink deposited onto predetermined portions of the base and the film of reflective material conforms to the textured pattern and to the surface of the base.

21. A method, comprising the steps of:

forming a textured pattern including raised portions on a base;

providing a film of reflective material;

applying the film of reflective material to the textured pattern such that one surface of the film substantially conforms to the textured pattern and the other surface of the film of reflective material defines a textured surface corresponding to the textured pattern; and forming an ink design substantially on the textured surface of the film of reflective material.

22. A method as claimed in claim 21, wherein the step of forming a textured pattern comprises depositing ultraviolet light curable ink substantially onto the base.

23. A method as claimed in claim 21, wherein the step of forming an ink design substantially on the textured surface of the film of reflective material comprises the step of depositing a first deposit of ink substantially on the textured surface of the film of reflective material in such a manner that first portions of the textured surface of the film of reflective material are covered by the first deposit of ink and second portions of the textured surface of the film of reflective material are left uncovered.

24. A method as claimed in claim 23, wherein the step of forming an ink design substantially on the first surface of the film of reflective material further comprises depositing a second deposit of ink over the first deposit of ink and uncovered portions of the textured surface of the film of reflective material, the first deposit of ink being substantially less translucent than the second deposit of ink.

25. A method as claimed in claim 24, wherein the first deposit of ink comprises a substantially opaque ink and the second deposit of ink comprises a substantially translucent ink.

26. A method as claimed in claim 21, further comprising the step of:

depositing a layer of substantially transparent material over the ink design.

27. A method as claimed in claim 21, wherein the ink design comprises substantially translucent ink.

28. A method, comprising the steps of:

providing a base defining a surface;

forming a textured pattern on the surface of the base;

securing a material to the textured pattern and base such that the material substantially conforms to the textured pattern and defines a raised surface corresponding to the textured pattern; and forming an ink design on the raised surface of the material after the material has been secured to the textured pattern.

29. A method as claimed in claim 28, wherein the step of forming a textured pattern on the surface of the base comprises depositing ultraviolet light curable ink onto the surface of the base.

30. A method as claimed in claim 28, wherein the ink design comprises substantially translucent ink.

31. A method as claimed in claim 28, wherein the material comprises a reflective film.

32. A method as claimed in claim 28, wherein the material comprises a reflective solution.

* * * * *